US006768402B2

(12) United States Patent
Davidson et al.

(10) Patent No.: US 6,768,402 B2
(45) Date of Patent: Jul. 27, 2004

(54) EXTERNALLY CONTROLLABLE CIRCUIT BREAKER

(75) Inventors: David L. Davidson, Camden, SC (US); Wayne G. Adamson, Lincoln, NE (US); Kevin A. Simms, Houston, PA (US); Kenneth L. Uhlman, Moon, PA (US)

(73) Assignee: Eaton Corporation, Cleveland, OH (US)

( * ) Notice: Subject to any disclaimer, the term of this patent is extended or adjusted under 35 U.S.C. 154(b) by 26 days.

(21) Appl. No.: 10/123,073

(22) Filed: Apr. 15, 2002

(65) Prior Publication Data

US 2003/0193381 A1 Oct. 16, 2003

(51) Int. Cl.[7] ..... H01H 77/00
(52) U.S. Cl. ..... 335/14; 335/20
(58) Field of Search ..... 335/14, 20, 202, 335/132, 18, 167–176, 6; 361/42–51, 54, 102, 114–115

(56) References Cited

U.S. PATENT DOCUMENTS 4,412,193 A 10/1983 Bienwald et al.
4,884,048 A 11/1989 Castonguay et al.
4,947,284 A * 8/1990 Munyon et al. ..... 361/92
5,202,662 A 4/1993 Bienwald et al.
5,250,920 A 10/1993 Fujihisa et al.
5,293,522 A 3/1994 Fello et al.
5,301,083 A 4/1994 Grass et al.
5,373,411 A 12/1994 Grass et al.
5,381,121 A 1/1995 Peter et al.
5,414,395 A 5/1995 Garnto et al.
6,060,797 A * 5/2000 Harris et al. ..... 310/14
6,259,339 B1 7/2001 Simms et al.

* cited by examiner

*Primary Examiner*—Lincoln Donovan
(74) *Attorney, Agent, or Firm*—M. J. Moran

(57) ABSTRACT

An externally controllable circuit breaker includes a set of main contacts, an operating mechanism for opening and closing the main contacts; and a set of secondary contacts electrically connected in series with the main contacts. A control mechanism to open and close the secondary contacts includes an electromagnet with an armature having a first position, which opens the secondary contacts, and a second position, which closes the secondary contacts. The electromagnet also includes a coil electrically interconnected with the main contacts for energization therefrom and adapted for control by one or two external signals from one or two external contacts to operate the armature between the first and second positions.

23 Claims, 6 Drawing Sheets

EXTERNALLY CONTROLLABLE CIRCUIT BREAKER

CROSS-REFERENCE TO RELATED APPLICATIONS

This application is related to U.S. patent application Ser. No. 09/514,458, filed Feb. 28, 2000, now U.S. Pat. No. 6,388,858, entitled: "Remotely Controllable Circuit Breaker"; and commonly owned U.S. patent application Ser. No. 09/709,252, filed Nov. 8, 2000, now U.S. Pat. No. 6,507,255, entitled: "Remotely Controllable Circuit Breaker".

BACKGROUND OF THE INVENTION

1. Field of the Invention

This invention relates to circuit breakers for protecting electric power circuits. More particularly, it relates to circuit breakers with a set of secondary contacts, which are controllable through an operator, such as a magnetically latchable solenoid.

2. Background Information

Circuit breakers used in residential and light commercial applications are commonly referred to as miniature circuit breakers because of their limited size. Such circuit breakers typically have a pair of separable contacts opened and closed by a spring biased operating mechanism. A thermal-magnetic trip device actuates the operating mechanism to open the separable contacts in response to persistent overcurrent conditions and to short circuits. Usually, circuit breakers of this type for multiple circuits within a residence or commercial structure are mounted together within a load center which may be located in a basement or other remote location. In some applications, it has been found convenient to use the circuit breakers for other purposes than just protection, for instance, for load shedding. It is desirable to be able to perform this function remotely, and even automatically, such as under the control of a computer. However, the spring biased operating mechanisms are designed for manual reclosure and are not easily adapted for reclosing remotely. In any event, such operating mechanisms are not designed for repeated operation over an extended period of time.

U.S. Pat. Nos. 5,301,083 and 5,373,411 describe a remotely operated circuit breaker, which introduces a second pair of contacts in series with the main separable contacts. The main contacts still interrupt the overcurrent, while the secondary contacts perform the discretionary switching operations. The secondary contacts are controlled by a solenoid, which is spring biased to close the contacts. The solenoid has two coils, an opening coil and a holding coil. Initially, both coils are energized to open the contacts. Power to the opening coil is then turned off, and only the holding coil remains energized. Thus, continuous power is required to keep the main contacts open. When power to the holding relay is terminated, the spring recloses the secondary contacts.

U.S. Pat. No. 6,259,339 discloses a remotely operated circuit breaker, which introduces secondary contacts in series with main separable contacts. The secondary contacts are controlled by a solenoid, which has two coils, a first (or close) coil and a second (or open) coil. The coils are concentrically wound on a steel core supported by a steel frame. A plunger moves rectilinearly within the coils. A permanent magnet is seated between the steel core and the steel frame. When the close coil is energized, a magnetic field is produced which counteracts the magnetic field produced by the permanent magnet. A spring then pushes the contact arm closed. The secondary contacts are maintained in the closed state by a spring. When it is desired to open the secondary contacts, the open coil is energized which lifts the plunger to open the secondary contacts. With the plunger in the full upward position, it contacts the steel core and is retained in this second position by the permanent magnet. Subsequently, when the close coil is energized, the magnetic field generated is stronger than the field of the permanent magnet and therefore overrides the latter and moves the plunger back to the closed position.

There is room for improvement in externally operated circuit breakers.

SUMMARY OF THE INVENTION

This need and others are satisfied by the invention, which is directed to an externally controllable circuit breaker having a set of main contacts, a set of secondary contacts, and a control mechanism for opening and closing the set of secondary contacts. The control mechanism includes an electromagnet having a coil, which is electrically interconnected with the set of main contacts for energization therefrom and adapted for control by an external signal.

In accordance with the invention, an externally controllable circuit breaker comprises a set of main contacts; an operating mechanism for opening and closing the set of main contacts; a set of secondary contacts electrically connected in series with the set of main contacts; a control mechanism for opening and closing the set of secondary contacts, the control mechanism comprises an electromagnet including an armature having a first position which opens the set of secondary contacts and having a second position which closes the set of secondary contacts, the electromagnet also including a coil electrically interconnected with the set of main contacts for energization therefrom and adapted for control by at least one external signal to operate the armature between the first position and the second position.

As another aspect of the invention, a circuit breaker comprises a set of main contacts; an operating mechanism for opening and closing the set of main contacts; a set of secondary contacts electrically connected in series with the set of main contacts; means for opening and closing the set of secondary contacts in response to at least one external signal; and means for energizing the means for opening and closing from the set of main contacts.

It is an object of the invention to provide an externally controllable circuit breaker for which external control circuitry is simple and economical to implement.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
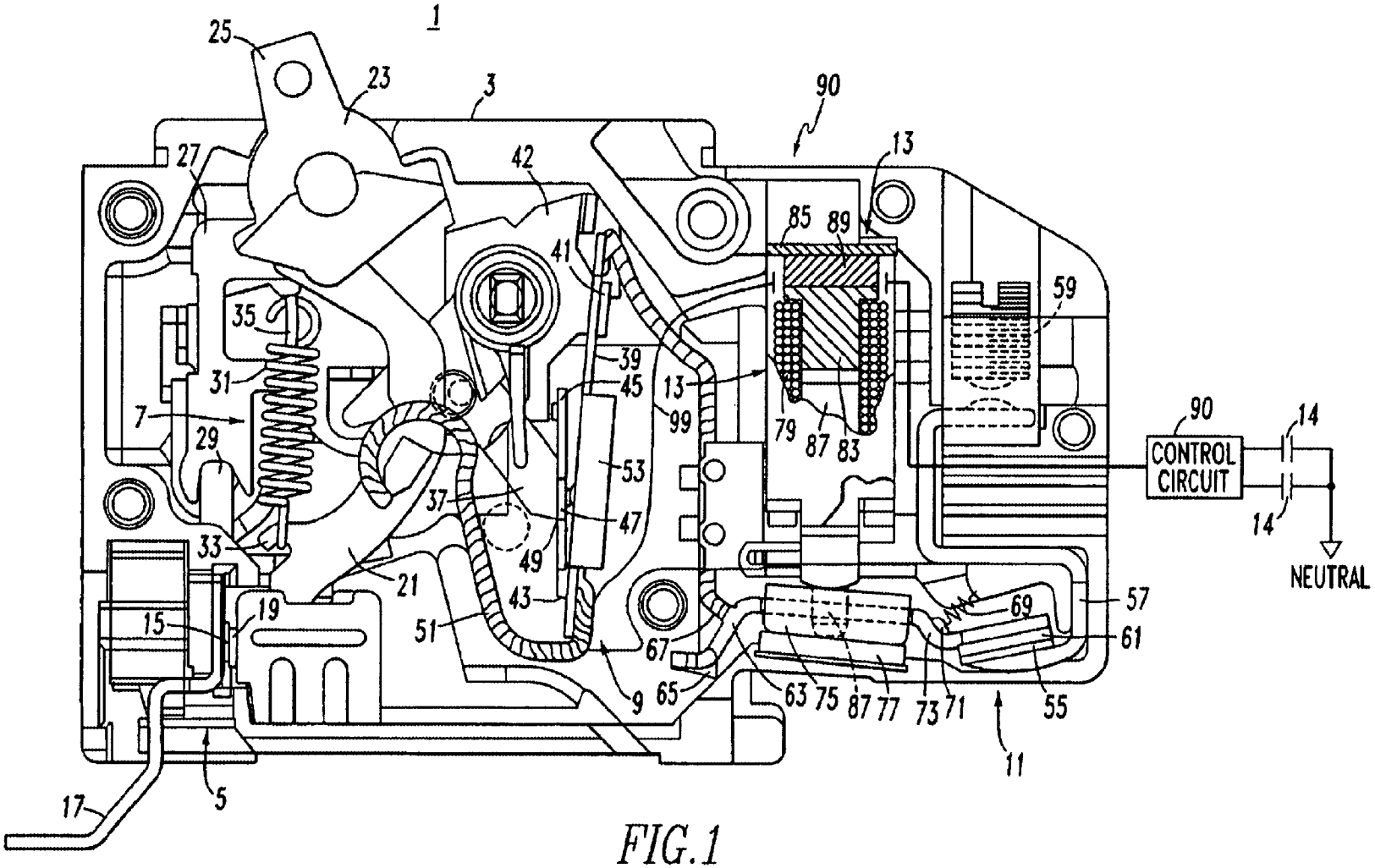
FIG. 1 is an elevational view of an externally controllable circuit breaker in accordance with the invention shown with the cover removed and with the main contacts and secondary contacts closed.
Figure 2:
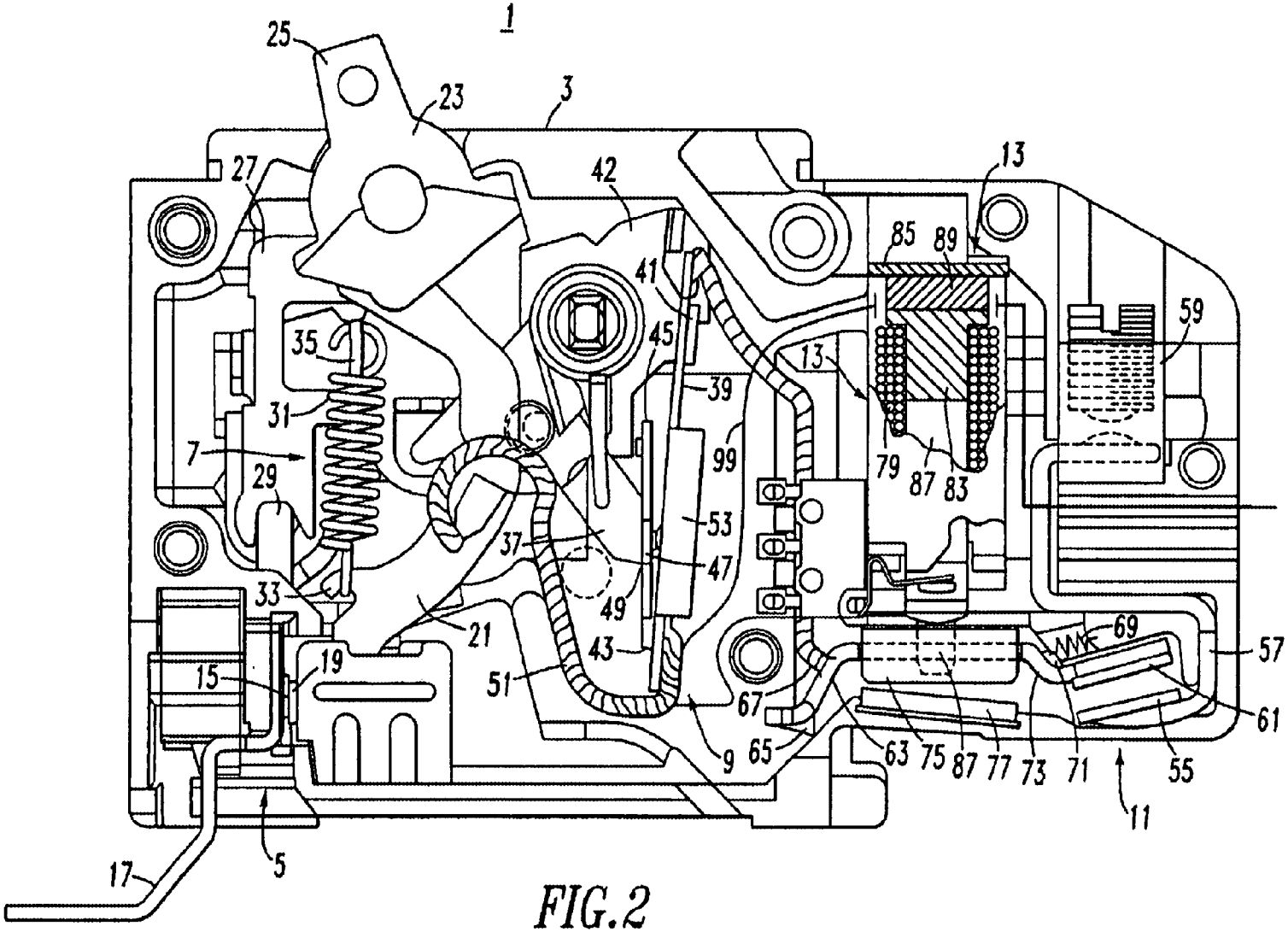
FIG. 2 is a view similar to that of FIG. 1, but with the secondary contacts open.

The invention will be described as applied to a miniature circuit breaker, although it will become apparent that it could be applied to other types of circuit breakers as well. Such a miniature circuit breaker 1 includes a molded housing 3 and is shown in FIGS. 1 and 2 with the cover of the housing removed. The basic components of the circuit breaker 1 are a set of main contacts 5, an operating mechanism 7 for opening the main contacts 5, and a thermal-magnetic trip device 9 which actuates the operating mechanism 7 to trip the main contacts 5 open in response to certain overcurrent or short circuit conditions. Further included are a set of secondary contacts 11 and an actuator in the form of an exemplary magnetically latchable solenoid 13 which is externally controllable by one or two external contacts 14 to control the open and closed states of the secondary contacts 11.

The set of main contacts 5 includes a fixed contact 15 secured to a line terminal 17 and a movable main contact 19 which is affixed to an arcuate contact arm 21 which forms part of the operating mechanism 7. The operating mechanism 7 is a well-known device, which includes a pivotally mounted operator 23 with an integrally molded handle 25. The operating mechanism 7 also includes a cradle 27 pivotally mounted on a support 29 molded in the housing 3. With the handle 25 in the closed position, as shown in FIGS. 1 and 2, a spring 31 connected to a hook 33 on the contact arm 21 and a tab 35 on the cradle 27 holds the main contacts 5 closed. The spring 31 also applies a force with the main contacts 5 closed, as shown, to the cradle 27 which tends to rotate the cradle in a clockwise direction about the support 29. However, the cradle 27 has a finger 37, which is engaged by the thermal-magnetic trip device 9 to prevent this clockwise rotation of the cradle under normal operating conditions.

The thermal-magnetic trip device 9 includes an elongated bimetal 39 which is fixed at its upper end to a tab 41 on a metal frame 42 seated in the molded housing 3. Attached to the lower, free end of the bimetal 39 by a lead spring 43 is an armature 45. The armature 45 has an opening 47, which is engaged by a latching surface 49 on the cradle finger 37.

The free end of the bimetal 39 is connected to the contact arm 21 by a flexible braided conductor 51 in order that the load current of the circuit protected by the circuit breaker 1 passes through the bimetal. A persistent overcurrent heats the bimetal 39, which causes the lower end thereof to move to the right, with respect to FIGS. 1 and 2. If this overcurrent is of sufficient magnitude and duration, the latching surface 49 on the finger 37 is pulled out of engagement with the armature 45. This allows the cradle 27 to be rotated clockwise by the spring 31. The clockwise rotation of the cradle 27 moves the upper pivot point for the contact arm 21 across the line of force of the spring 31 in order that the contact arm is rotated counterclockwise, to open the main contacts 5, as is well understood. This also results in the handle 25 rotating to an intermediate position (not shown) to indicate the tripped condition of the main contacts 5.

In addition to the armature 45, a magnetic pole piece 53 is supported by the bimetal 39. Very high overcurrents, such as those associated with a short circuit, produce a magnetic field which draws the armature 45 to the pole piece 53, thereby also releasing the cradle 27 and tripping the main contacts 5 open. Following either trip, the main contacts 5 are reclosed by moving the handle 25 fully clockwise, which rotates the cradle 27 counterclockwise until the finger 37 relatches in the opening 47 in the armature 45. Upon release of the handle 25, it moves counterclockwise slightly from the full clockwise position and remains there. With the cradle relatched, the line of force of the spring 31 is reestablished to rotate the contact arm 21 clockwise to close the main contacts 5 when the handle 25 is rotated fully counterclockwise to the position shown in FIGS. 1 and 2.

The set of secondary contacts 11 includes a fixed secondary contact 55 which is secured on a load conductor 57 that leads to a load terminal 59. The set of secondary contacts 11 also includes a movable secondary contact 61 which is fixed to a secondary contact arm 63 that at its opposite end is seated in a molded pocket 65 in the molded housing 3. The secondary contact arm 63 is electrically connected in series with the main contacts 5 by a second flexible braided conductor 67 connected to the fixed end of the bimetal 39. Thus, a circuit or load current is established from the line terminal 17 through the main contacts 5, the contact arm 21, the flexible braided conductor 51, the bimetal 39, the second flexible braided conductor 67, the secondary contact arm 63, the secondary contacts 11, and the load conductor 57 to the load terminal 59.

The set of secondary contacts 11 is biased to the closed state shown in FIG. 1 by a helical compression spring 69 seated on a projection 71 on an offset 73 in the secondary contact arm 63. As discussed in U.S. Pat. No. 5,301,083, the spring 69 is oriented such that the force that it applies to the secondary contact arm 63 tending to close the secondary contacts is relaxed to a degree with the secondary contacts 11 in the open position of FIG. 2. This serves the dual purpose of providing the force needed to close the secondary contacts 11 against rated current in the protected circuit and also reducing the force that must be generated by the magnetically latching solenoid 13 to hold the secondary contacts in the open state. In order for the secondary contacts 11 to withstand short circuit currents and allow the main contacts 5 to perform the interruption, the magnet force generated by the short circuit current causes an armature 75 mounted on the secondary contact arm 63 to be attracted to a pole piece 77 seated in the molded housing 3 thereby clamping the secondary contacts closed.

As shown by the partial sections in FIGS. 1 and 2, the actuator/solenoid 13 includes an open/close coil 79 wound on a steel core 83 supported by a steel frame 85. A plunger 87 moves rectilinearly within the exemplary single coil 79. A permanent magnet 89 is seated between the steel core 83 and the steel frame 85. To operate the coil 79, when the plunger 87 is not seated against the core 83 and a magnetic field is induced by applying a suitable voltage to the windings of the coil 79, the core 83 and the plunger 87 then attract magnetically, pulling the plunger 87 against the core 83. The magnet 89 then holds the plunger 87 against the core 83 without an induced electrical field. To release the plunger 87 from the core 83, an opposite flux field is induced in the coil windings by applying an opposite polarity voltage thereto. When the opposite field is applied, the magnetic field from the permanent magnet 89 is zeroed out or decreased to the point where a light axial load is capable of pulling the plunger 87 away from the core 83.

The plunger 87 engages the secondary contact arm 63. When the open/close coil 79 is energized with a close polarity signal (e.g., a negative voltage in the exemplary embodiment), a magnetic field is produced which drives the plunger 87 downward to a first position which rotates the secondary contact arm 63 clockwise and thereby moves the secondary contacts 11 to the closed state. The secondary contacts 11 are maintained in the closed state by the spring 69 as shown in FIG. 1.

When it is desired to open the secondary contacts 11, the open/close coil 79 is energized with an open polarity signal (e.g., a positive voltage in the exemplary embodiment), which lifts the plunger 87 and with it the secondary contact arm 63 to a second position which opens the secondary contacts 11. With the plunger 87 in the full upward position as shown in FIG. 2, it contacts the steel core 83 and is retained in this second position by the permanent magnet 89. Subsequently, when the open/close coil 79 is again energized with the close polarity signal, the magnetic field generated is stronger than the field generated by the permanent magnet 89 and, therefore, overrides the latter and moves the plunger 87 back to the first, or closed position.

The exemplary circuit breaker 1 includes a control circuit 90 (e.g., such as diodes 226,228 of FIG. 4) for opening and closing the secondary contacts 11. The control circuit 90 also includes an electromagnet, such as the exemplary latching solenoid 13, having an armature, such as the exemplary plunger 87, with a first position which opens the secondary contacts 11 and a second position which closes such contacts 11. The exemplary solenoid coil 79 is electrically interconnected through conductor 99 with the main contacts 5 for energization therefrom and adapted for control by external signals, such as the external contacts 14, to operate the plunger 87 between the first and second positions.

Figure 3:
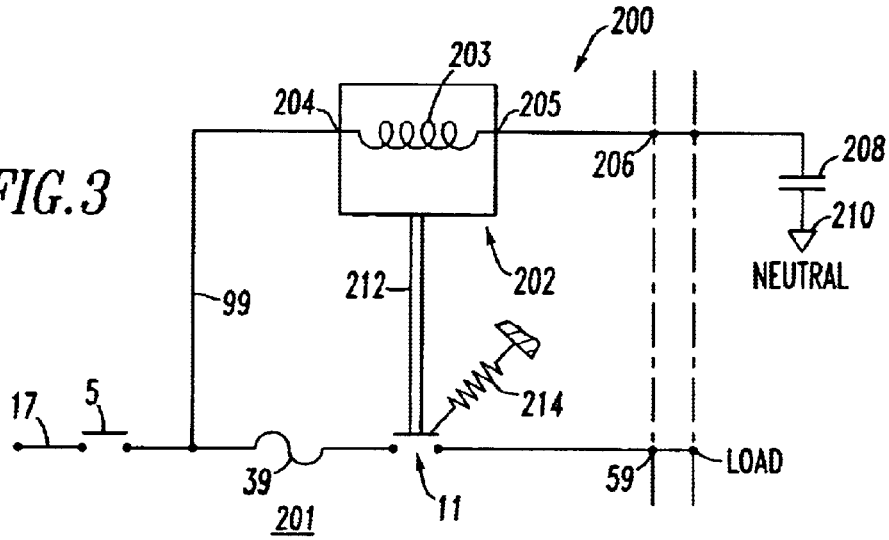
FIGS. 3–10 are schematic circuit diagrams of various control circuits for externally controllable circuit breakers in accordance with other embodiments of the invention.

FIG. 3 shows an example of a control circuit 200 for an externally controllable circuit breaker 201, which is somewhat similar to the circuit breaker 1 of FIGS. 1 and 2. An electromagnet, such as a solenoid 202, includes a coil 203, a first terminal 204 electrically interconnected with the load side of the main contacts 5, and a second terminal 205. The coil second terminal 205 is adapted for electrical connection through terminal 206 with an external switchable contact 208 having an external signal (e.g., a closed state or an open state with respect to a power supply neutral 210). The closed state of the external contact 208 energizes the coil 203 from the line voltage of the closed set of main contacts 5 in order to operate the armature 212 (e.g., upward with respect to FIG. 3) to open the secondary contacts 11, while the open state of the external contact 208 de-energizes the coil 203 in order to operate the armature 212 (e.g., downward with respect to FIG. 3) under the bias of spring 214 to close the secondary contacts 11.

Figure 4:
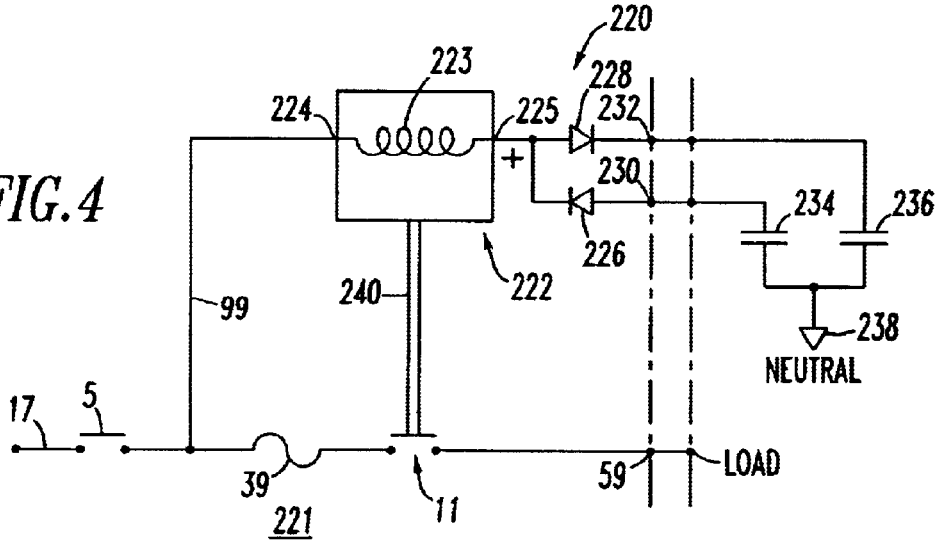

FIG. 4 shows a control circuit 220 for an externally controllable circuit breaker 221, which is similar to the circuit breaker 1 of FIGS. 1 and 2. An electromagnet, such as a solenoid 222, includes a coil 223, a first terminal 224 electrically interconnected with the load side of the main contacts 5, and a second terminal 225. The control circuit 220 includes a diode 226 having a cathode electrically connected to the second coil terminal 225, and another diode 228 having an anode electrically connected to the second coil terminal 225. The anode of the first diode 226 is electrically connected to a first terminal 230, and the cathode of the second diode 228 is electrically connected to a second terminal 232.

Two external switchable contacts 234,236 have corresponding external signals (e.g., a closed state or an open state with respect to a power supply neutral 238). The second coil terminal 225 is adapted for electrical connection to the neutral 238 through the first diode 226 and the first external contact 234, or alternatively for electrical connection to the neutral 238 through the second diode 228 and the second external contact 236. The closed state of the contact 234 energizes the coil 223 from the main contacts 5 with a positive polarity, as defined by the diode 226, in order to operate the armature 240 (i.e., upward with respect to FIG. 4) to open the secondary contacts 11. The closed state of the contact 236 energizes the coil 223 from the main contacts 5 with the opposite negative polarity, as defined by the diode 228, in order to operate the armature 240 (i.e., downward with respect to FIG. 4) to close the secondary contacts 11.

Preferably, the electromagnet 222 is a latching solenoid and the armature 240 is a plunger which is latchable to the upward position, which opens the secondary contacts 11, and is latchable to the downward position, which closes the secondary contacts 11. In this example, the contacts 234,236 may be momentary contacts, with the contact 234 being momentarily closed to energize the coil 223 (when the contacts 5 are closed and energized from the line terminal 17) through the diode 226 with a first polarity voltage (e.g., positive with respect to the exemplary positive terminal 225) to open the secondary contacts 11, and with the contact 236 being momentarily closed to energize the coil 223 through the diode 228 with an opposite second polarity voltage (e.g., negative with respect to the exemplary positive terminal 225) to close the secondary contacts 11.

Figure 5:
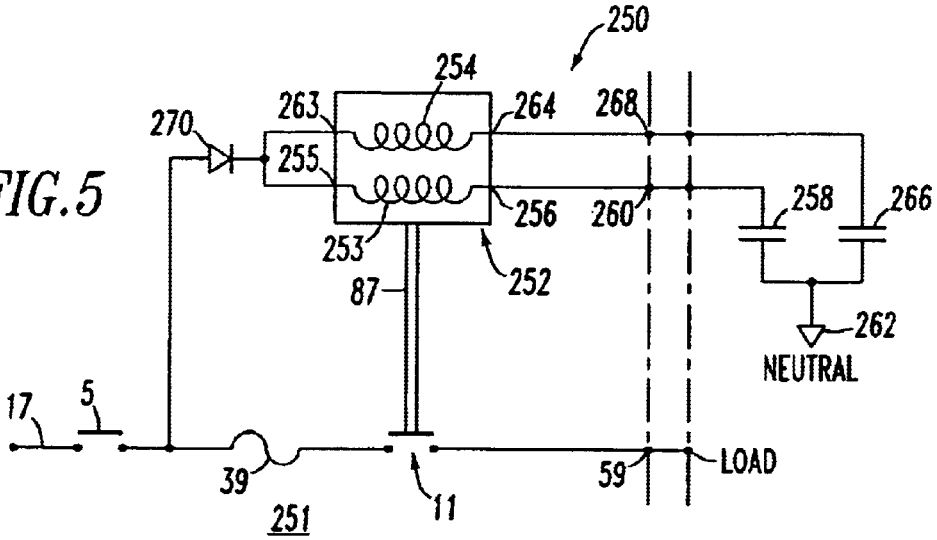

FIG. 5 shows a control circuit 250 for an externally controllable circuit breaker 251, which is somewhat similar to the circuit breaker 1 of FIGS. 1 and 2. An electromagnet, such as a solenoid 252, includes two coils 253,254. An example of the solenoid 252 and coils 253,254 is disclosed in U.S. Pat. No. 6,259,339, which is incorporated by reference herein. The first coil 253 has first and second terminals 255,256, with the second terminal 256 being adapted for electrical connection with a first external contact 258 through a terminal 260. The contact 258 provides an external signal (e.g., a closed state or an open state with respect to a power supply neutral 262). Similarly, the second coil 254 has first and second terminals 263,264, with the second terminal 264 being adapted for electrical connection with a second external contact 266 through a terminal 268. The contact 266 provides an external signal (e.g., a closed state or an open state with respect to the power supply neutral 262). The control circuit 250 also includes a diode 270 having an anode and a cathode, with the anode being electrically interconnected with the load side of the main contacts 5, and with the cathode being electrically connected to the first terminals 255,263 of the respective coils 253,254.

In this embodiment, the contacts 258,266 are preferably momentary contacts, in order to minimize power consumption by the coils 253,254. The closed state of the first contact 258 energizes the first coil 253 from the main contacts 5 (when closed and energized from the line terminal 17) and through the diode 270, in order to operate the armature 87 to an open position and open the secondary contacts 11. Alternatively, the closed state of the second contact 266 energizes the second coil 254, in order to operate the armature 87 to the closed position and close the secondary contacts 11.

Figure 6:
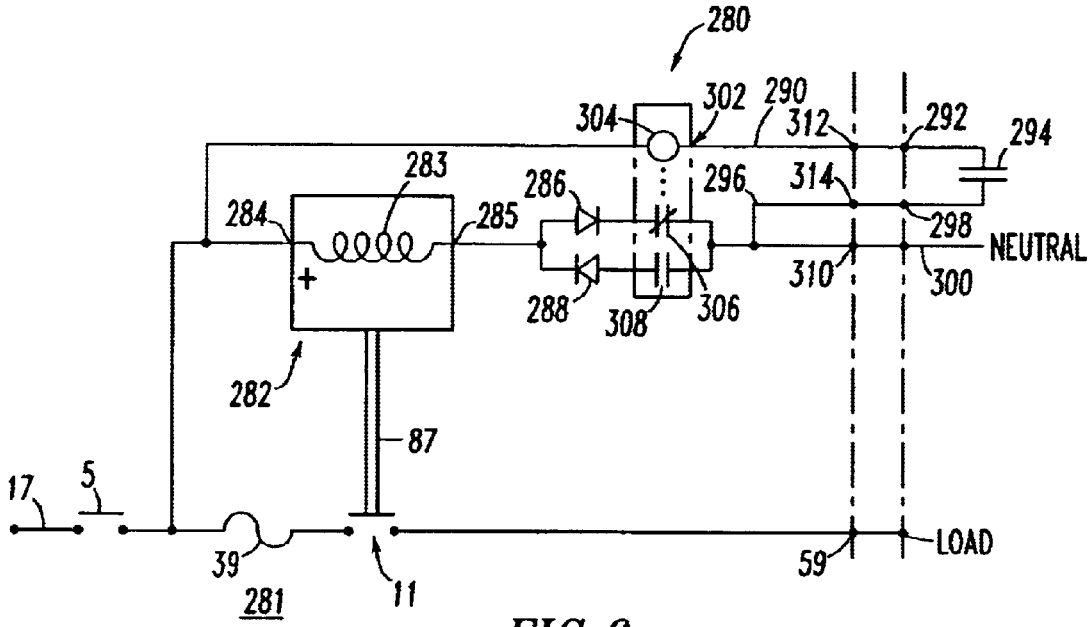

FIG. 6 shows a control circuit 280 for an externally controllable circuit breaker 281, which is similar to the circuit breaker 221 of FIG. 4. An electromagnet, such as a solenoid 282, includes a coil 283, a first terminal 284 electrically interconnected with the load side of the main contacts 5, and a second terminal 285.

The control circuit 280 further includes a first diode 286, a second diode 288, a first node 290 adapted for electrical connection with a first lead 292 of an external contact 294, a second node 296 adapted for electrical connection with a second lead 298 of the external contact 294 and a power supply neutral 300, and a control relay 302. The control relay 302 has a coil 304, a normally closed contact 306 and a normally open contact 308. The first diode 286 has a first polarity and is electrically interconnected in series with the normally closed contact 306 between the second terminal 285 of the electromagnet coil 283 and the second node 296. The second diode 288 has an opposite second polarity with respect to the first diode 286 and is electrically interconnected in series with the normally open contact 308 between the second terminal 285 of the electromagnet coil 283 and the second node 296.

The external switchable contact 294 has an external signal (e.g., a closed state or an open state with respect to the power supply neutral 300). The relay coil 304 is adapted for control by the external contact 294. The second terminal 285 of the electromagnet coil 283 is adapted for electrical connection to the neutral 300 through the first diode 286 and the normally closed contact 306, or alternatively for electrical connection to the neutral 300 through the second diode 288 and the normally open contact 308. The closed state of the external contact 294 energizes the relay coil 304, closes the normally open contact 308, and energizes the electromagnet coil 283 with a first polarity voltage (e.g., in the exemplary embodiment, negative with respect to the coil terminal 284) to close the secondary contacts 11. Otherwise, the external contact 294 being open de-energizes the relay coil 304, closes the normally closed contact 306, and energizes the electromagnet coil 283 with an opposite second polarity voltage (e.g., in the exemplary embodiment, negative with respect to the coil terminal 284) to open the secondary contacts 11.

The control circuit 280 further includes a neutral terminal 310, which is adapted for electrical connection to the second node 296 and the neutral 300. A first contact terminal 312 is adapted for electrical connection to the first node 290 and the first lead 292 of the external contact 294. A second contact terminal 314 is adapted for electrical connection to the second node 296 and the second lead 298 of the external contact 294. In this manner, a user may readily electrically connect the neutral 300 to the terminal 310, and may also readily electrically connect the leads 292,298 of the external contact 294 to the respective terminals 312,314.

The exemplary electromagnet coil 283 receives power directly from the main contacts 5, although the invention is applicable to control circuits which provide one or more circuit protection devices (e.g., fuses), in order to protect the coils 283,304 and other downstream circuitry and wiring.

Figure 7:
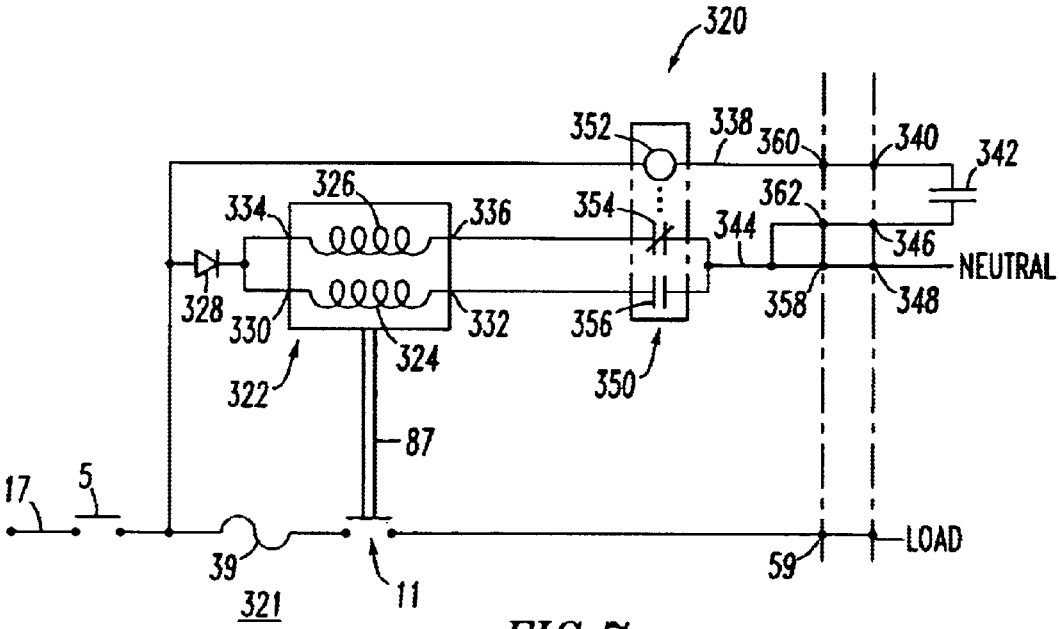

FIG. 7 shows a control circuit 320 for an externally controllable circuit breaker 321, which is similar to the circuit breaker 251 of FIG. 5. An electromagnet, such as a solenoid 322, includes a first coil 324, a second coil 326 and a diode 328. The first coil 324 has a first terminal 330 and a second terminal 332, and the second coil 326 has a first terminal 334 and a second terminal 336. A first node 338 is adapted for electrical connection with a first lead 340 of an external contact 342, and a second node 344 is adapted for electrical connection with a second lead 346 of the external contact 342 and a neutral 348. The control circuit 320 further includes a control relay 350 having a coil 352, a normally closed contact 354 and a normally open contact 356. The diode 328 is electrically interconnected between the load side of the main contacts 5 and the first terminals 330,334 of the respective first and second electromagnet coils 324,326. The normally open contact 356 is electrically connected between the second terminal 332 of the first electromagnet coil 324 and the second node 344. The normally closed contact 354 is electrically connected between the second terminal 336 of the second electromagnet coil 326 and the second node 344.

The external switchable contact 342 has an external signal (e.g., a closed state or an open state with respect to the power supply neutral 348). The relay coil 352 is adapted for control by the external contact 342. The second terminal 332 of the first coil 324 is adapted for electrical connection to neutral 348 through the normally open contact 356, and the second terminal 336 of the second coil 326 is adapted for electrical connection to neutral 348 through the normally closed contact 354. The first and second electromagnet coils 324, 326 receive power through the diode 328 from the main contacts 5. The closed state of the external contact 342 energizes the relay coil 352, closes the normally open contact 356, and energizes the first electromagnet coil 324 to close the secondary contacts 11. Alternatively, the external contact 342 being open de-energizes the relay coil 352, closes the normally closed contact 354, and energizes the second electromagnet coil 326 to open the secondary contacts 11.

Similar to the control circuit 280 of FIG. 6, the control circuit 320 further includes a neutral terminal 358, which is adapted for electrical connection to the second node 344 and the neutral 348. A first contact terminal 360 is adapted for electrical connection to the first node 338 and the first lead 340 of the external contact 342. A second contact terminal 362 is adapted for electrical connection to the second node 344 and the second lead 346 of the external contact 342.

Figure 8:
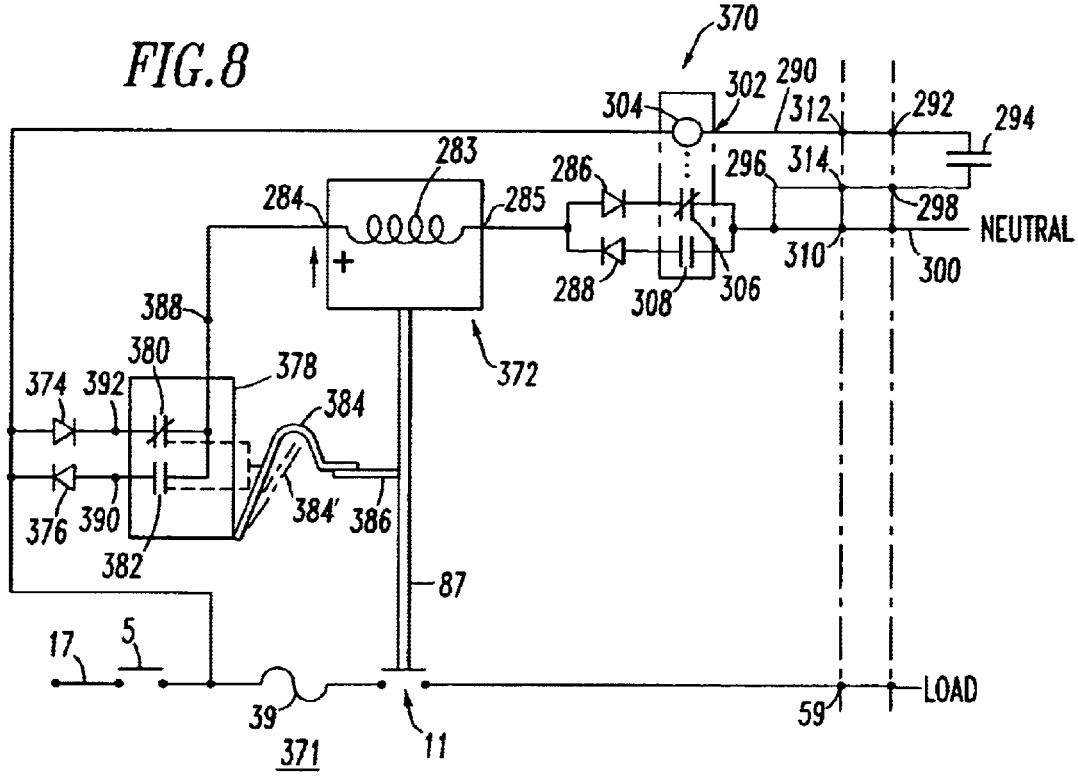

FIG. 8 shows a control circuit 370 for an externally controllable circuit breaker 371, which is similar to the circuit breaker 281 of FIG. 6. An electromagnet, such as a solenoid 372, is similar to the solenoid 282 of FIG. 6, except that it receives power from the load side of the main separable contacts 5 as discussed below. The control circuit 370 includes the relay 302 of FIG. 6, a third diode 374, a fourth diode 376, and a switch, such as a micro-switch 378, having a normally closed contact 380, a normally open contact 382, and an operator or actuating lever 384. The armature 87 of the electromagnet 372 includes a member or projection 386, which engages the switch operator 384 for movement therewith. The third diode 374 is electrically interconnected in series with the normally closed contact 380 between the main contacts 5 and the first terminal 284 of the electromagnet coil 283. The fourth diode 376 has an opposite polarity with respect to the third diode 374 and is electrically interconnected in series with the normally open contact 382 between the main contacts 5 and the first terminal 284 of the electromagnet coil 283.

As discussed above in connection with FIG. 6, whenever the external contact 294 is closed, this energizes the relay coil 304 and closes the normally open relay contact 308. Then, when the set of secondary contacts 11 is open, the normally open switch contact 382 is closed by operation of the armature member 386 lifting (with respect to FIG. 8) the switch operator 384, in order to actuate the micro-switch 378. In turn, this energizes the electromagnet coil 283 with a first polarity voltage (i.e., negative with respect to the first terminal 284 of the electromagnet coil 283) through diodes 288,376 until the set of secondary contacts 11 is closed. With the secondary contacts 11 then being closed, the normally open switch contact 382 is open by operation of the armature member 386 lowering (with respect to FIG. 8) the switch operator 384, thereby advantageously de-energizing the electromagnet coil 283.

On the other hand, whenever the external contact 294 is open, this de-energizes the relay coil 304 and closes the normally closed relay contact 306. Then, when the secondary contacts 11 are closed, the normally open switch contact 382 is open and the normally closed switch contact 380 is closed by operation of the armature member 386 lowering (with respect to FIG. 8) the switch operator 384, in order to de-actuate the micro-switch 378. This energizes the electromagnet coil 283 with an opposite second polarity voltage (i.e., positive with respect to the first terminal 284 of the electromagnet coil 283) through diodes 374,286 until the set of secondary contacts 11 is open. With the secondary contacts 11 then being open, the normally open switch contact 382 is closed by operation of the armature member 386 lifting (with respect to FIG. 8) the switch operator 384. In turn, the normally closed switch contact 380 is open, thereby advantageously de-energizing the electromagnet coil 283.

As discussed above, the electromagnet coil 283 receives power through one of the two series combinations of: (1) the third diode 374, the normally closed switch contact 380, the coil 283, the first diode 286 and the normally closed relay contact 306, or (2) the normally open relay contact 308, the second diode 288, the coil 283, the normally open switch contact 382 and the fourth diode 376. The micro-switch 378 serves as an internal power cutoff device by switching power between a common terminal 388 and first and second switched terminals 390,392. The common terminal 388 of the micro-switch 378 is electrically connected to the first coil terminal 284. The first switched terminal 390 of the micro-switch 378 is electrically connected to the anode of diode 376, and the second switched terminal 392 of the micro-switch 378 is electrically connected to the cathode of diode 374. The cathode of diode 376 and the anode of diode 374 are electrically connected together and to the load side of the main separable contacts 5. Thus, the first switched terminal 390 is selectively electrically connectable to the common terminal 388, and the second switched terminal 392 is alternatively selectively electrically connectable to the common terminal 388.

When the solenoid 372 is latched in the upward or second position (as shown with the solenoid 13 of FIG. 2) in order that the set of secondary contacts 11 is open, the micro-switch 378 is actuated and, thus, the normally open switch contact 382 is closed and the normally closed switch contact 380 is open. In this state, when the external contact 294 is closed, the relay coil 304 is energized, and the relay normally open contact 308 is closed, then the negative voltage (with respect to the electromagnet coil terminal 284) through the diodes 288,376 energizes the electromagnet coil 283 to effect downward movement of the plunger 87 to its first position. This closes the secondary contacts 11 and allows the actuating lever 384 of the micro-switch 378 to move to the non-actuated position (as shown in phantom at 384' in FIG. 8). This results in opening of the normally open contact 382 and closure of the normally closed contact 380 to de-energize the electromagnet coil 283. However, the set of secondary contacts 11 remains latched in the closed position due to the spring 69 of FIG. 2.

With the normally closed contact 380 now closed, the coil 283 is enabled by application of the positive voltage through the diodes 374,286. However, no current flows through the coil 283 until the external contact 294 is open and the relay normally closed contact 306 is closed. In turn, the positive voltage energizes the coil 283 to effect upward movement of the plunger 87, in order to open the secondary contacts 11.

Further flexibility is available when it is considered that the coupling between the plunger 87 and the micro-switch 378 may be arranged so that the actuating lever 384 of the switch is actuated when the plunger 87 is in the first downward position and the set of secondary contacts 11 is closed. As the set of secondary contacts 11 is latched in either the open state or the closed state, it is not necessary to provide continuous power to the exemplary electromagnet coil 283 in order to maintain such set in either state.

Figure 9:
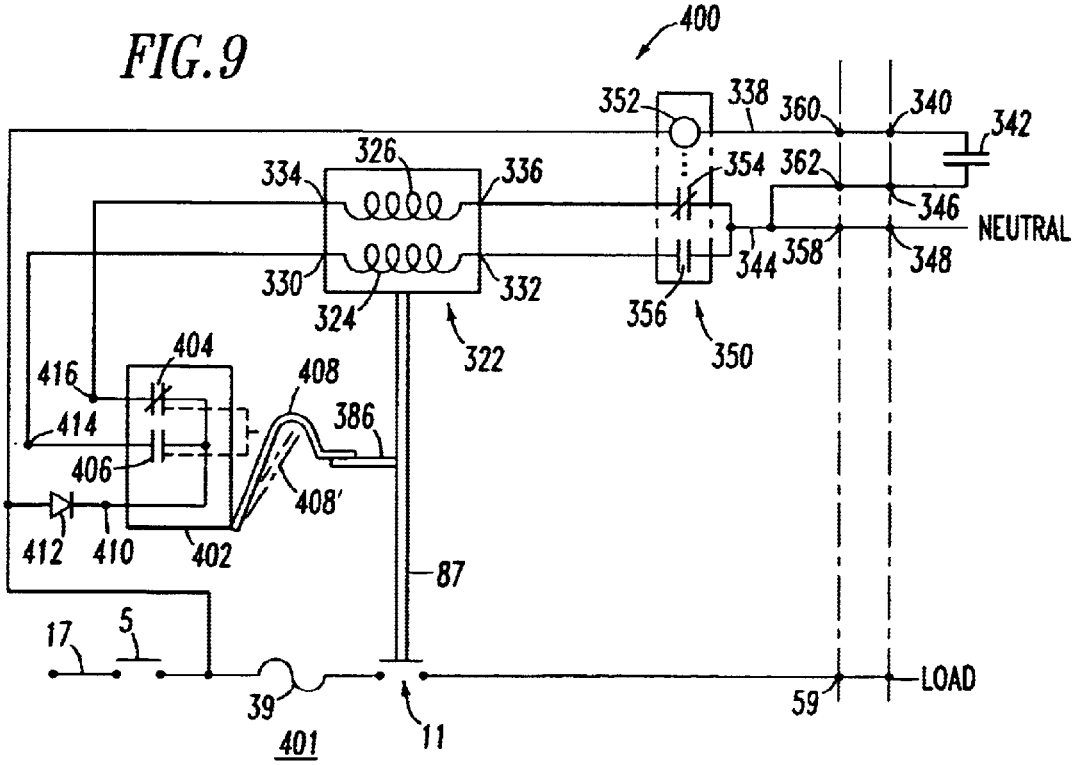

FIG. 9 shows a control circuit 400 for an externally controllable circuit breaker 401, which is similar to the circuit breaker 321 of FIG. 7, and which employs a micro-switch 402, which is similar to the micro-switch 378 of FIG. 8. The electromagnet 322 of FIG. 9 receives power from the load side of the main separable contacts 5 and through the micro-switch 402 as discussed below.

The micro-switch 402 has a normally closed contact 404, a normally open contact 406, and an operator 408 shown in an actuated position (a non-actuated position is shown in phantom at 408' of FIG. 9). The member 386 of the armature 87 engages the switch operator 408 for movement therewith. The common terminal 410 of the micro-switch 402 is electrically connected to the cathode of a diode 412. The first switched terminal 414 of the micro-switch 402 is electrically connected to the first terminal 330 of the first coil 324, and the second switched terminal 416 of the micro-switch 402 is electrically connected to the first terminal 334 of the second coil 326. The anode of the diode 412 is electrically connected to the load side of the main separable contacts 5. The diode 412 is electrically interconnected in series with the normally closed switch contact 404 between the main contacts 5 and the first terminal 334 of the second electromagnet coil 326. The diode 412 is also electrically interconnected in series with the normally open switch contact 406 between the main contacts 5 and the first terminal 330 of the first electromagnet coil 324.

When the external contact 342 is closed, the relay coil 352 is energized and the normally open relay contact 356 is closed. With the set of secondary contacts 11 being open, the normally open switch contact 406 is also closed, thereby energizing the first electromagnet coil 324 (which receives power from the line terminal 17 and the closed main contacts 5 through the series combination of the diode 412, closed contact 406, the coil 324 and the closed contact 356) until the set of secondary contacts 11 is closed. In turn, with the secondary contacts 11 then being closed, the normally open switch contact 406 is open, thereby advantageously de-energizing the first electromagnet coil 324.

Subsequently, when the external contact 342 is open, the relay coil 352 is de-energized and the normally closed relay contact 354 is closed. With the secondary contacts 11 being closed, the normally open switch contact 406 is open and the normally closed switch contact 404 is closed, thereby energizing the second electromagnet coil 326 (which receives power from the line terminal 17 and the closed main contacts 5 through the series combination of the diode 412, closed contact 404, the coil 326 and the closed contact 354) until the set of secondary contacts 11 is open. In turn, with the secondary contacts 11 then being open, the normally open switch contact 406 is closed and the normally closed switch contact 404 is open, thereby advantageously de-energizing the second electromagnet coil 326.

Figure 10:
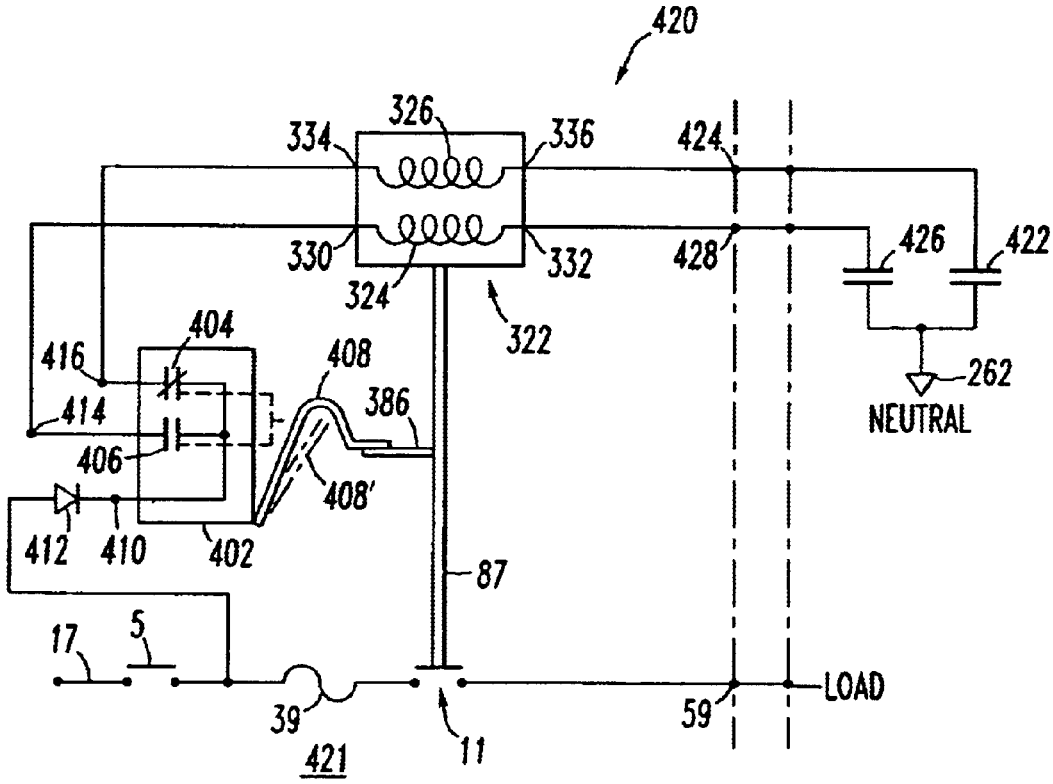

FIG. 10 shows a control circuit 420 for an externally controllable circuit breaker 421, which is similar to the circuit breaker 401 of FIG. 9, except that the control relay 350 of FIG. 9 is eliminated. Also, similar to the control circuit 250 of FIG. 5, the first coil terminal 336 is adapted for electrical connection with a first external contact 422 through a terminal 424. The contact 422 provides an external signal (e.g., a closed state or an open state with respect to a power supply neutral 262). Similarly, the second coil terminal 332 is adapted for electrical connection with a second external contact 426 through a terminal 428. The contact 426 provides an external signal (e.g., a closed state or an open state with respect to the power supply neutral 262).

The exemplary externally controllable circuit breakers 1, 201, 221, 251, 281, 321, 371, 401, and 421 disclosed herein include an externally controlled set of secondary contacts 11, which are opened and closed by externally generated signals, such as by the respective external contacts 14, 208, 234 and 236, 258 and 266, 294, 342, 294, 342, and 422 and 426. Those external contacts are advantageously energized by the control circuits 90, 200, 220, 250, 280, 320, 370, 400, and 420 of such externally controllable circuit breakers, respectively.

Although for economy of disclosure, some of the circuit breakers, such as 201 of FIG. 3, employ a single terminal, such as 206, for an external contact, such as 208, with such contact being externally electrically connected to a neutral, such as 210, any of the exemplary embodiments may employ two terminals, such as 312,314 of FIG. 6 for an external contact, such as 294, and a third terminal, such as 310, for a neutral, such as 300. In this manner, the exemplary external contacts may be remotely located with respect to the corresponding circuit breakers, or may be locally located external to such circuit breakers.

Some of the embodiments disclosed herein, such as the circuit breakers 221 of FIG. 4 and 251 of FIG. 5, may employ a latching solenoid, such as 222 and 252, and momentary external contacts, such as 234,236 and 258,266, for controlling the corresponding latching solenoid in order that continuous power is not required to maintain the secondary contacts 11 in one state or the other.

Still other embodiments, such as the circuit breakers 371 of FIG. 8 and 401 of FIG. 9, employ an internally switched interface, in order that continuous power to an electromagnet, such as 372 and 322, is not needed to maintain the secondary contacts 11 in one state or the other.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. An externally controllable circuit breaker comprising:

a set of main contacts;

an operating mechanism for opening and closing said set of main contacts;

a set of secondary contacts electrically connected in series with said set of main contacts;

a control mechanism for opening and closing said set of secondary contacts, said control mechanism comprising an electromagnet including an armature having a first position which opens said set of secondary contacts and having a second position which closes said set of secondary contacts, said electromagnet also including a coil electrically interconnected with said set of main contacts for energization therefrom and adapted for control by at least one external signal to operate said armature between said first position and said second position.

2. The externally controllable circuit breaker of claim 1 wherein said electromagnet is a latching solenoid; and wherein said armature is a plunger which is latchable to the first position which opens said set of secondary contacts and is latchable to the second position which closes said set of secondary contacts.

3. The externally controllable circuit breaker of claim 1 wherein said control mechanism further comprises a neutral terminal which is adapted for electrical connection to an external contact having said external signal.

4. The externally controllable circuit breaker of claim 1 wherein said coil has a first terminal electrically interconnected with said set of main contacts, and a second terminal adapted for electrical connection with an external contact having said external signal.

5. The externally controllable circuit breaker of claim 4 wherein said second terminal is adapted for electrical connection to a neutral through said external contact, which is a switchable contact having a closed state and an open state; wherein the closed state of said external contact energizes said coil from said set of main contacts in order to operate said armature to said first position and open said set of secondary contacts; and wherein the open state of said external contact de-energizes said coil in order to operate said armature to said second position and close said set of secondary contacts.

6. The externally controllable circuit breaker of claim 4 wherein said control mechanism further comprises a first diode having an anode and a cathode and a second diode having an anode and a cathode, with the cathode of said first diode electrically connected to the second terminal of said coil, with the anode of said second diode electrically connected to the second terminal of said coil; wherein said external contact is a first contact having a closed state and an open state; wherein said coil is adapted for control by a second contact having a closed state and an open state; wherein the second terminal of said coil is adapted for electrical connection to a neutral through said first diode and said first contact, or alternatively for electrical connection to said neutral through said second diode and said second contact; wherein the closed state of said first contact energizes said coil from said set of main contacts in order to operate said armature to said first position and open said set of secondary contacts; and wherein the closed state of said second contact energizes said coil in order to operate said armature to said second position and close said set of secondary contacts.

7. The externally controllable circuit breaker of claim 6 wherein said electromagnet is a latching solenoid; and wherein said armature is a plunger which is latchable to the first position which opens said set of secondary contacts and is latchable to the second position which closes said set of secondary contacts.

8. The externally controllable circuit breaker of claim 7 wherein said first contact is closed to energize said coil through said first diode with a first polarity voltage to open said set of secondary contacts; and wherein said second contact is closed to energize said coil through said second diode with a different second polarity voltage to close said set of secondary contacts.

9. The externally controllable circuit breaker of claim 8 wherein said first and second contacts are momentary contacts.

10. The externally controllable circuit breaker of claim 1 wherein said coil is a first coil having a first terminal and a second terminal, with the second terminal being adapted for electrical connection with a first contact having a first one of said at least one external signal, a closed state and an open state; wherein said electromagnet also includes a second coil having a first terminal and a second terminal; wherein said control mechanism further comprises a diode having an anode and a cathode, with the anode of said diode electrically interconnected with said set of main contacts, with the cathode of said diode electrically connected to the first terminal of said first and second coils; wherein said second coil is adapted for control by a second contact having a second one of said at least one external signal, a closed state and an open state; wherein the second terminal of said first coil is adapted for electrical connection to a neutral through said first contact; wherein the second terminal of said second coil is adapted for electrical connection to said neutral through said second contact; wherein the closed state of said first contact energizes said first coil from said set of main contacts in order to operate said armature to said first position and open said set of secondary contacts; and wherein the closed state of said second contact energizes said second coil in order to operate said armature to said second position and close said set of secondary contacts.

11. The externally controllable circuit breaker of claim 10 wherein said first and second contacts are momentary contacts.

12. The externally controllable circuit breaker of claim 1 wherein the coil of said electromagnet has a first terminal electrically interconnected with the set of main contacts and a second terminal; wherein said control mechanism further comprises a first diode, a second diode, a first node adapted for electrical connection with a first lead of an external contact having a closed state and an open state, a second node adapted for electrical connection with a second lead of said external contact and a neutral, and a relay having a coil, a normally closed contact and a normally open contact, with said first diode having a first polarity and being electrically interconnected in series with said normally closed contact between the second terminal of the coil of said electromagnet and said second node, and with said second diode having an opposite second polarity and being electrically interconnected in series with said normally open contact between the second terminal of the coil of said electromagnet and said second node; wherein the coil of said relay is adapted for control by said external contact; wherein the second terminal of the coil of said electromagnet is adapted for electrical connection to said neutral through said first diode and said normally closed contact, or alternatively for electrical connection to said neutral through said second diode and said normally open contact; wherein the closed state of said external contact energizes the coil of said relay, closes said normally open contact, and energizes the coil of said electromagnet with a first polarity voltage to close said secondary contacts; and wherein said external contact being open de-energizes the coil of said relay, closes said normally closed contact, and energizes the coil of said electromagnet with an opposite second polarity voltage to open said secondary contacts.

13. The externally controllable circuit breaker of claim 12 wherein said control mechanism further comprises a neutral terminal which is adapted for electrical connection to said second node and said neutral, a first contact terminal which is adapted for electrical connection to said first node and the first lead of said external contact, and a second contact terminal which is adapted for electrical connection to said second node and the second lead of said external contact.

14. The externally controllable circuit breaker of claim 12 wherein the coil of said electromagnet receives power from the set of main contacts.

15. The externally controllable circuit breaker of claim 1 wherein the coil of said electromagnet is a first coil having a first terminal and a second terminal; wherein said electromagnet also includes a second coil having a first terminal and a second terminal; wherein said control mechanism further comprises a diode, a first node adapted for electrical connection with a first lead of an external contact having a closed state and an open state, a second node adapted for electrical connection with a second lead of said external contact and a neutral, and a relay having a coil, a normally closed contact and a normally open contact, with said diode being electrically interconnected between the set of main contacts and the first terminal of the first and second coils of said electromagnet; with said normally open contact being electrically connected between the second terminal of the first coil of said electromagnet and said second node, and with said normally closed contact being electrically connected between the second terminal of said second coil of said electromagnet and said second node; wherein the coil of said relay is adapted for control by said external contact; wherein the second terminal of the first coil of said electromagnet is adapted for electrical connection to said neutral through said normally open contact, wherein the second terminal of the second coil of said electromagnet is adapted for electrical connection to said neutral through said normally closed contact; wherein the closed state of said external contact energizes the coil of said relay, closes said normally open contact, and energizes the first coil of said electromagnet to close said secondary contacts; and wherein said external contact being open de-energizes the coil of said relay, closes said normally closed contact, and energizes the second coil of said electromagnet to open said secondary contacts.

16. The externally controllable circuit breaker of claim 15 wherein said control mechanism further comprises a neutral terminal which is adapted for electrical connection to said second node and said neutral, a first contact terminal which is adapted for electrical connection to said first node and the first lead of said external contact, and a second contact terminal which is adapted for electrical connection to said second node and the second lead of said external contact.

17. The externally controllable circuit breaker of claim 15 wherein the first and second coils of said electromagnet receive power through said diode from the set of main contacts.

18. The externally controllable circuit breaker of claim 12 wherein said control mechanism further comprises a third diode, a fourth diode, and a switch having a normally closed contact, a normally open contact, and an operator, wherein the armature of said electromagnet includes a member which engages the operator of said switch for movement therewith; with said third diode having the first polarity and being electrically interconnected in series with the normally closed contact of said switch between said set of main contacts and the first terminal of the coil of said electromagnet, and with said fourth diode having the opposite second polarity and being electrically interconnected in series with the normally open contact of said switch between the set of main contacts and the first terminal of the coil of said electromagnet; wherein said external contact being closed energizes the coil of said relay and closes the normally open contact of said relay, and with the set of secondary contacts being open, the normally open contact of said switch is closed, thereby energizing the coil of said electromagnet with the first polarity voltage until the set of secondary contacts is closed, and with the set of secondary contacts then being closed, the normally open contact of said switch is open, thereby de-energizing the coil of said electromagnet; and wherein said external contact being open de-energizes the coil of said relay and closes the normally closed contact of said relay, and with the set of secondary contacts being closed, the normally open contact of said switch is open and the normally closed contact of said switch is closed, thereby energizing the coil of said electromagnet with the second polarity voltage until the set of secondary contacts is open, and with the set of secondary contacts then being open, the normally open contact of said switch is closed and the normally closed contact of said switch is open, thereby de-energizing the coil of said electromagnet.

19. The externally controllable circuit breaker of claim 18 wherein the coil of said electromagnet receives power through one of the series combinations of said third diode and the normally closed contact of said switch, and the fourth diode and the normally open contact of said switch.

20. The externally controllable circuit breaker of claim 18 wherein said control mechanism further comprises a neutral terminal which is adapted for electrical connection to said external contact.

21. The externally controllable circuit breaker of claim 15 wherein said control mechanism farther comprises a switch having a normally closed contact, a normally open contact, and an operator; wherein the armature of said electromagnet includes a member which engages the operator of said switch for movement therewith; with said diode being electrically interconnected in series with the normally closed contact of said switch between said set of main contacts and the first terminal of the second coil of said electromagnet, and with said diode being electrically interconnected in series with the normally open contact of said switch between the set of main contacts and the first terminal of the first coil of said electromagnet; wherein said external contact being closed energizes the coil of said relay and closes the normally open contact of said relay, and with the set of secondary contacts being open, thereby energizing the first coil of said electromagnet until the set of secondary contacts is closed, and with the set of secondary contacts then being closed, the normally open contact of said switch is open, thereby de-energizing the first coil of said electromagnet; and wherein said external contact being open de-energizes the coil of said relay and closes the normally closed contact of said relay, and with the set of secondary contacts being closed, the normally open contact of said switch is open and the normally closed contact of said switch is closed, thereby energizing the second coil of said electromagnet until the set of secondary contacts is open, and with the set of secondary contacts then being open, the normally open contact of said switch is closed and the normally closed contact of said switch is open, thereby de-energizing the second coil of said electromagnet.

22. The externally controllable circuit breaker of claim 21 wherein the first coil of said electromagnet receives power through the series combination of said diode and the normally open contact of said switch, and the second coil of said electromagnet receives power through the series combination of said diode and the normally closed contact of said switch.

23. The externally controllable circuit breaker of claim 10 wherein said control mechanism further comprises a switch having a normally closed contact, a normally open contact, and an operator, wherein the armature of said electromagnet includes a member which engages the operator of said switch for movement therewith; with said diode being electrically interconnected in series with the normally closed contact of said switch between said set of main contacts and the first terminal of the second coil of said electromagnet, and with said diode being electrically interconnected in series with the normally open contact of said switch between the set of main contacts and the first terminal of the first coil of said electromagnet.

* * * * *